US006533611B2

(12) United States Patent
Morello et al.

(10) Patent No.: US 6,533,611 B2
(45) Date of Patent: Mar. 18, 2003

(54) ELECTRICAL CONNECTOR ASSEMBLY WITH SECONDARY TERMINAL LOCK

(75) Inventors: John R. Morello, Warren, OH (US); Jon C. Hobbs, Burghill, OH (US); Guodong Chen, Hudson, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/961,849

(22) Filed: Sep. 24, 2001

(65) Prior Publication Data

US 2002/0039863 A1 Apr. 4, 2002

Related U.S. Application Data

(60) Provisional application No. 60/237,668, filed on Oct. 3, 2000.

(51) Int. Cl.[7] ..... H01R 13/422
(52) U.S. Cl. ..... 439/595
(58) Field of Search ..... 439/595, 752

(56) References Cited

U.S. PATENT DOCUMENTS 5,489,223 A * 2/1996 Faje et al. ..... 439/748
5,522,740 A * 6/1996 Plocek et al. ..... 439/752
5,622,521 A * 4/1997 Marceau et al. ..... 439/595

* cited by examiner

*Primary Examiner*—Gary Paumen
(74) *Attorney, Agent, or Firm*—Thomas N. Twomey

(57) ABSTRACT

A secondary terminal lock for an electrical connector assembly includes an inner connector and an outer connector. The inner connector defines at least one elongated terminal space adapted to receive a wire terminal. The outer connector defines a slot adapted to receive the inner connector in telescoping engagement. The secondary terminal lock is disposed adjacent to the terminal space and has a flexible shaft and a distal head having a cam lobe and a forward facing abutment. When the assembly is assembled with a terminal disposed in the terminal space and with the inner connector fitting within the outer connector, the cam lobe abuts the outer connector and causes the head to deflect and move the abutment behind the terminal to prevent the terminal from being removed from the inner connector in a rearward direction.

14 Claims, 2 Drawing Sheets

ELECTRICAL CONNECTOR ASSEMBLY WITH SECONDARY TERMINAL LOCK

This application claims the benefit of U.S. Provisional Application No. 60/237,668 filed Oct. 3, 2000, the disclosures of which are incorporated herein by reference in their entirety as if set forth at length.

TECHNICAL FIELD

The present invention relates to electrical connector assemblies, and more particularly to an electrical connector assembly having a secondary terminal locking feature.

BACKGROUND OF THE INVENTION

Persons skilled in the electrical connector arts know to use various lock features for insuring that a terminal stays seated in a connector.

In a common case, each wire or lead has a terminal crimped on its end. The terminal slides into a connector that usually hosts a number of other leads. Each terminal has a primary lock that prevents the lead from being pulled out of the connector once the terminal is inserted. As shown in FIG. 3, the primary lock is a spring-biased tang.

There is also a secondary terminal lock that prevents release of a terminal once it is inserted into the connector—in the event that the primary lock fails. The secondary terminal lock is usually some sort of abutment extending from the connector that abuts a portion of the terminal. One type of secondary terminal lock is a sliding version that includes a bar which slides laterally across the connector in a track behind the row of inserted terminals. Once the bar is inserted, it abuts the terminals to prevent them from being removed. Another type of secondary terminal lock involves a number of pins mounted on a hinged arm. The arm is hinged to the electrical connector so that it can be pivoted about its hinge to force the pins down and into position behind the terminals. Both designs are satisfactory, but they require an operation that is unnecessary. They also limit the number of applications. And, in the case of the slide lock, there are extra parts that are not always necessary.

SUMMARY

A secondary terminal lock for an electrical connector assembly includes an inner connector and an outer connector. The inner connector defines at least one elongated terminal space adapted to receive a wire terminal. The outer connector defines a slot adapted to receive the inner connector in telescoping engagement. The secondary terminal lock is disposed adjacent to the terminal space and has a flexible shaft and a distal head having a cam lobe and a forward facing abutment. When the assembly is assembled with a terminal disposed in the terminal space and with the inner connector fitting within the outer connector, the cam lobe slideably engages the outer connector and causes the head to deflect and move the abutment behind the terminal to prevent rearward movement of the terminal within the inner connector which would otherwise jeopardize the electrical continuity of the mated connector assembly.

Preferably, the inner connector has a plurality of such secondary terminal locks each aligned with their respective terminal space, and all actuated by the singular act of mating the inner connector with the outer connector. The inner connector preferably has a side wall which is disposed flush with the shaft of the secondary terminal lock prior to actuation. Also prior to actuation, the cam lobe of the secondary terminal lock projects laterally outward beyond the side wall, but is flexed inward, when engaging an inner surface of the outer connector which opposes and is in close proximity to the side wall of the inner connector.

An advantage of the present invention is the addition of a secondary terminal lock which does not require an extra assembly step to actuate.

Another advantage of the present invention is the incorporation of a secondary terminal lock which does not require extra parts.

FIGURES IN THE DRAWINGS

The present invention will now be described, by way of example, with reference to the accompanying drawings, in which.

DESCRIPTION OF THE PREFERRED EMBODIMENT

The present invention will now be described, by way of example, with reference to the accompanying drawings in which an electrical connector assembly is generally shown at 10.

Figure 1:
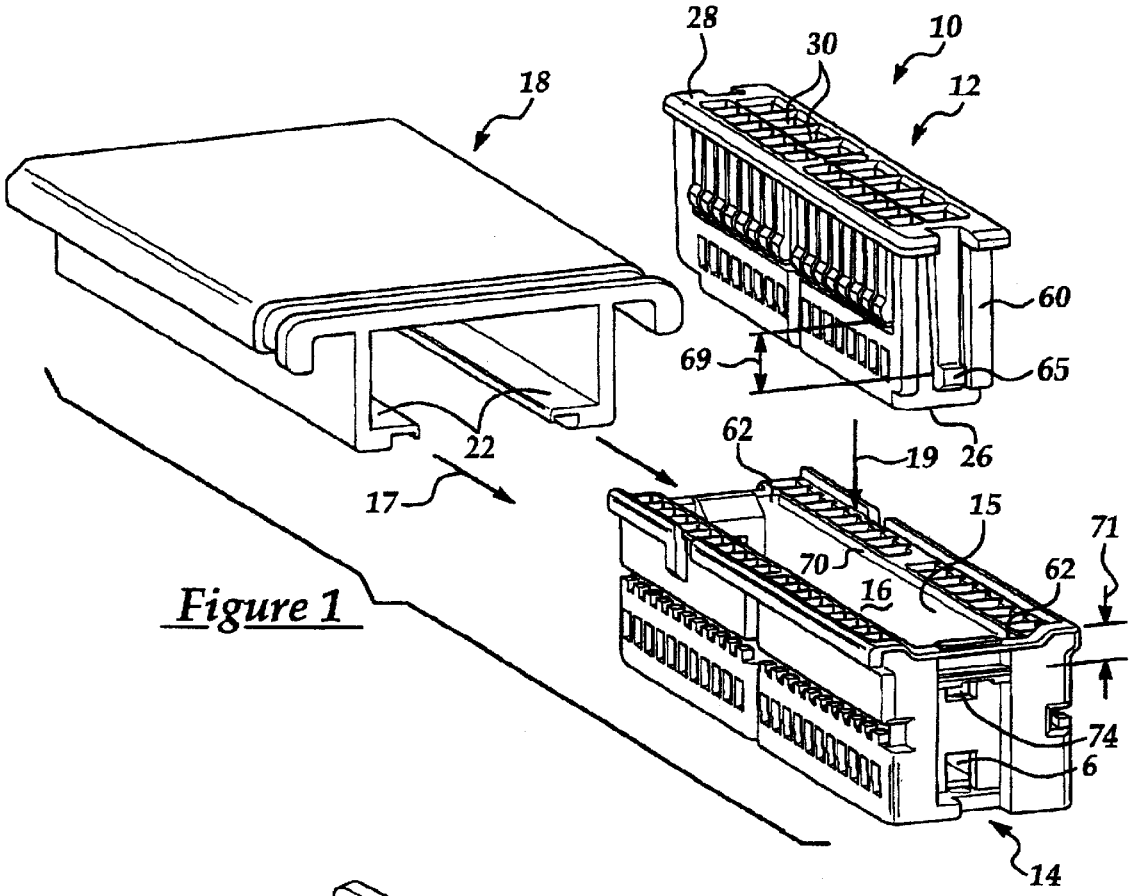
FIG. 1 is an exploded perspective view of an electrical connector assembly of the present invention.
Figure 3:
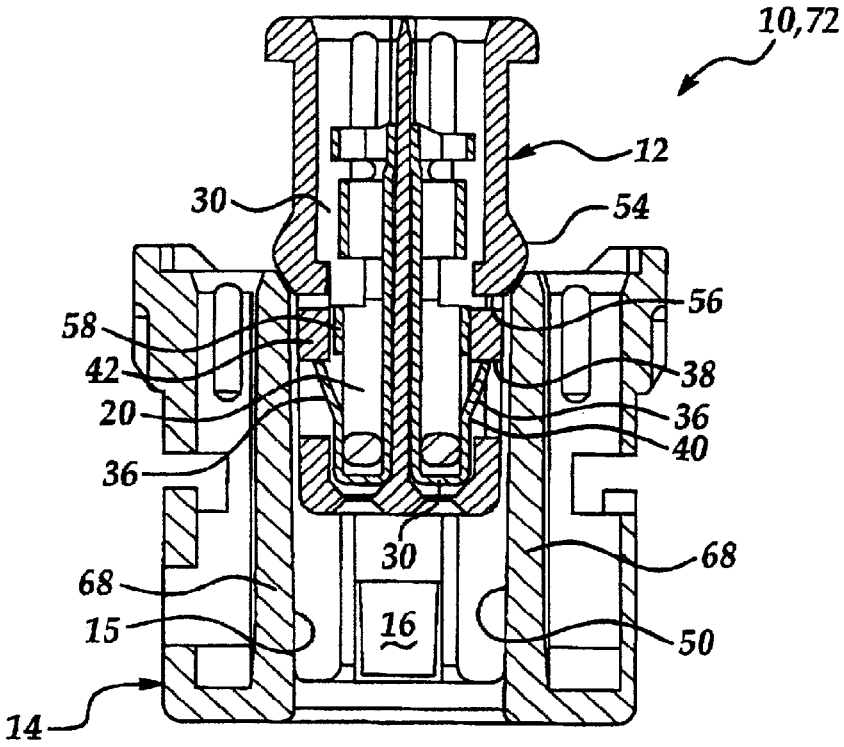
FIG. 3 is a sectional view of the inner connector disposed partly within an outer connector of the electrical connector assembly.

Referring to FIG. 1, the assembly 10 generally includes an inner connector 12 and an outer housing or connector 14. Opposing inner surfaces 15 of the outer connector 14 generally define an elongated slot 16 adapted to receive the inner connector 12 so that the two connectors fit together in a telescoping manner. A cover 18 fits over the outer connector 14 to protect a series of wires routed from a series of crimping terminals 20 engaged within the inner connector 12 (as best shown in FIG. 3) and which functions to lock in place a series of other terminals (not shown) engaged directly to the outer connector 14. Opposing rails 22 of the cover 18 slide within tracks 24 defined by the outer connector 14 in a direction 17 substantially perpendicular to the telescopic mating direction 19 of the inner and outer connectors 12, 14.

Figure 2:
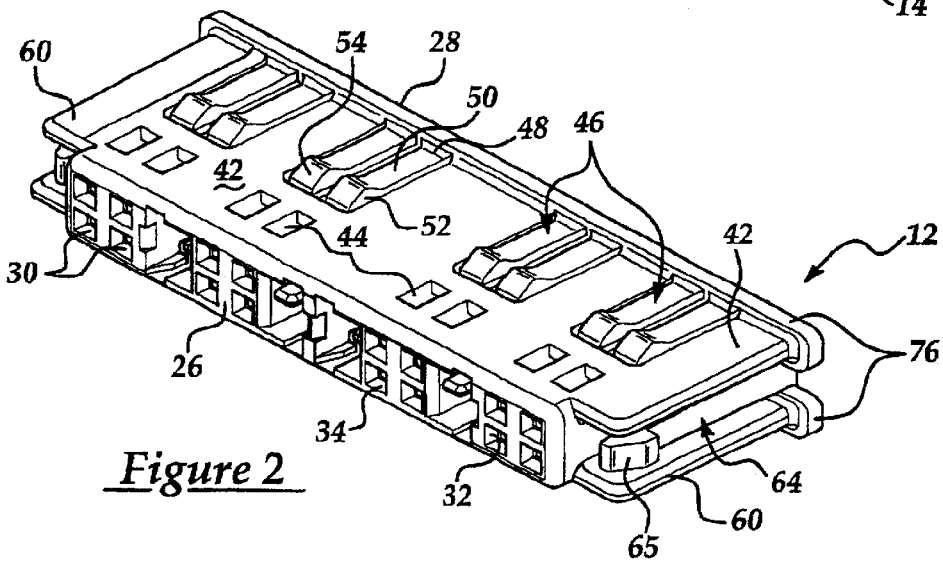
FIG. 2 is a rear perspective view of an inner connector of the electrical connector assembly.

Referring to FIGS. 2–3, the inner connector 12 extends between a forward face 26 and an opposite rearward face 28. At least one elongated terminal space 30 extending in the mating direction 19, is defined by the inner connector 12 and communicates through the forward and rearward faces 26, 28 for receiving the terminals 20. The version shown in FIG. 2 defines sixteen such spaces. The terminals 20 slide into the inner connector 12 through the rearward face 28 until a forward end 31 of each terminal 20 contacts a rearward facing surface of a ledge 32 which defines an aperture 34 disposed on the forward face 26 and communicating with the terminal space 30.

The terminals 20 each include a primary lock 36 that abuts a forward facing abutting surface 38 of the inner connector 12. The primary lock 36 is a slightly outward bent distal end portion or tang of a cantilevered member 40 which projects rearward from the forward end 31 of the terminal 20. During initial installation of the terminal 20 to the inner connector 12, the cantilevered member 40 flexes inward from the forward end as the tang 36 slides along a side wall 42 of the inner connector 12 until the tang 36 snaps outward into a hole 44 which communicates laterally through the side wall 42. The abutting surface 38 defines the rearward side or end of hole 42 and will engage the tang 36 should the terminal 20 be pushed rearward within the space 26 and away from the ledge 32.

The inner connector 12 further includes at least one elongated cam secondary terminal lock 46 which projects longitudinally forward and aligns over each respective terminal space 30. The projection of the cam secondary terminal lock 46 ends approximately mid-way along the space 30 stopping short of the respective holes 44. The cam secondary terminal lock includes a base 48, a shaft 50, and a distal end or head 52. The base 48 is attached unitarily to the inner connector 12 near or at the trailing face 28 and substantially lies flush within the side wall 42 of the inner connector 12. The shaft 50 is flexible to permit a degree of deflection so that a cam lobe 54 of the head 52, which projects laterally outward from the inner connector 12, can slideably engage the inner surface 15 of the outer connector 14 as the shaft 50 flexes inward. The head 52 also includes a forward facing abutment 56 for abutting a back member 58 of the terminal 20. The back member 58 substantially lies along the same imaginary plane as a forward portion of the cantilevered member 40.

Referring to FIGS. 1 and 2, the inner connector 12 also includes one or more guide flanges 60 which slide into corresponding channels 62 defined internally by the outer connector 14. Forward projecting elongated locking arms 64 are also provided on the inner connector 12 in order to retain the inner connector 12 within the outer connector 14. Each locking arm 64 has a beveled tang 65 projecting laterally outward from its distal end. The outer connector 14 is constructed to have at least one mating hole 66 for each locking tang 64. As the electrical connector assembly 10 fully mates, each beveled tang 65 snaps laterally outward into a respective mating hole 66 defined by the outer connector 14.

The inner surface 15 is defined by a shroud 68 of the outer connector 14 which also has a beveled edge or cam surface 70 at a rear end for engaging, and guiding inward, the cam lobe 54 on the cam secondary terminal lock 46 during initial insertion of the inner connector 12 to the outer connector 14.

Referring to FIG. 3, the connector assembly 10 is assembled by partially inserting the inner connector 12 into the slot 16 of the outer connector 14. This is referred to as the "staged" position 72, wherein the beveled tangs 65 of the locking tangs 64 first snap into a staged hole 74 in the outer connector. 14 positioned just rearward of the mating hole 66. The shaft 50 of the secondary terminal lock 46 remains flush with the side wall 42 of the inner connector 12 when the assembly 10 is in the staged position 72 so that insertion of the terminals 20 into the inner connector 12 will not be obstructed by the head 52. Therefore, a staged length 69 of the inner connector 12 measured forward from the leading most point of the cam lobe 54 to the trailing most point of the beveled tang 65 must be equal to, or slightly greater than, a staged distance 71 of the outer connector 14 measured forward from the cam surface 70 to the trailing most point of the staged hole 74. With inner connector 12 is temporarily retained in the staged position 72, either before or after this, the terminals 20 are crimped onto each wire or lead. Then each terminal 20 is fully inserted or mated into the inner connector 12 to the point that the primary lock 36 on each terminal 20 can deploy and stand ready to abut the abutting surface 38 in the outer connector 14.

Figure 4:
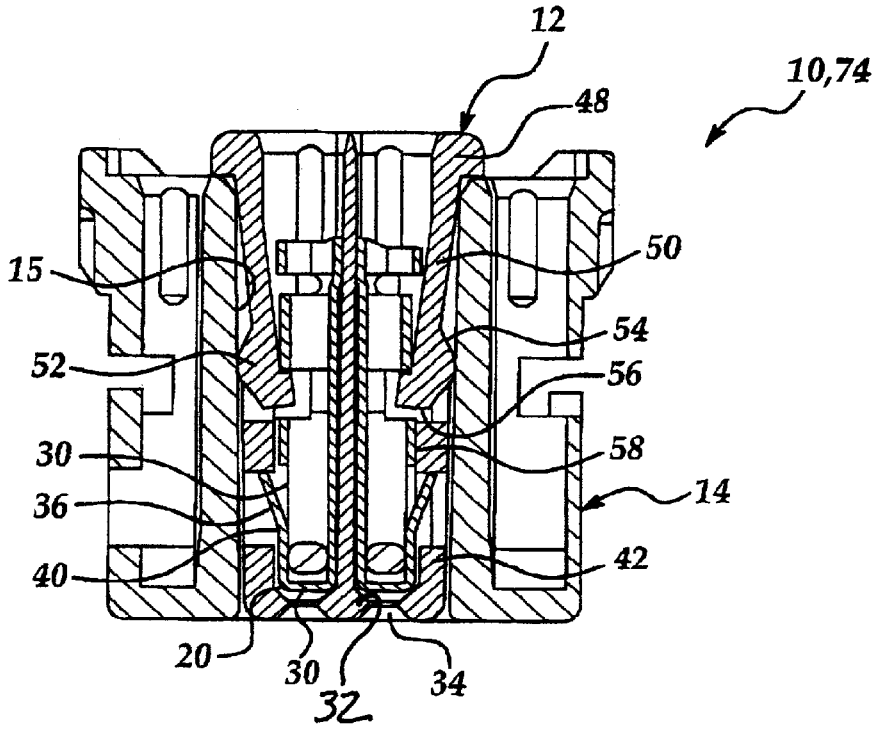
FIG. 4 is a sectional view similar to FIG. 3 showing the inner connector fully disposed within the outer connector.

Next, as shown in FIG. 4, the inner connector 12 can be moved into a fully inserted position 74. In the process of doing this, the cam edge or surface 70 on the mating shroud 68 engages the cam lobe 54 and forces the shaft 50 of the secondary terminal lock 46 to deflect laterally inwardly. The abutment 56 on the head 52 then moves down into position behind a rearward facing flat surface of the back member 58 of the terminal 20. The inner or under side of the head 52 is notched, as best shown in FIG. 4, to provide clearance over the back part or crimp portion of the terminal 20 to allow the head 52 to extend or pivot into position behind the back member 58 of the terminal 20. This arrangement perfects the secondary terminal lock 46 by preventing the terminal 20 from being removed from the inner connector 12 should the primary lock 36 fail.

Several features also control the degree to which the inner connector 12 moves into the outer connector 14. For instance, the locking arms 64 snap into the mating holes 66 of the outer connector 14 when the inner connector 12 reaches the desired fully inserted position 74. The inner connector 12 also includes a stop flange 76 which extends laterally outward from the inner connector 12 along the perimeter of the rearward face 28. The stop flange 76 abuts the outer connector 14 thereby preventing the inner connector 12 from being inserted too far forward. The outer connector 14 may also include a bar (not shown) to extend laterally across the track 24 to limit the extent to which the inner connector 12 may move within the outer connector 14.

One advantage of this cam-type secondary terminal lock 46 is that the secondary terminal lock 46 can be completed or activated in the same step that is involved in inserting the inner connector 12 into the outer connector 14. In other words, the secondary terminal lock 46 is activated by fully mating the inner connector 12 into the outer connector 14. Accordingly, this design essentially removes one fill operation that is involved in the prior art designs.

Although the preferred embodiments of the present invention are disclosed various changes and modifications may be made thereto by one skilled in the art without departing from the scope and spirit of the invention as set forth in the appended claims. Furthermore it is understood that the terms used herein are merely descriptive rather than limiting and various changes may be made without departing from the scope and spirit of the invention.

We claim:

1. An electrical connector assembly comprising:

an inner connector defining a terminal space adapted to receive a wire terminal;

an outer housing defining a slot adapted to receive the inner connector in telescoping engagement;

the inner connector having a secondary terminal lock having a base, a shaft and a head, the shaft located between the head and the base, the base engaged to the inner connector, the head having a forward facing abutment, the secondary terminal lock being disposed adjacent the terminal space so that when the assembly is assembled with a terminal disposed in the terminal space and with the inner connector fitting within the outer housing, a cam lobe of the head projects outwardly beyond the adjacent side walls of the inner connector and abuts the outer housing and causes the shaft and head to deflect inward and move the abutment behind the terminal to prevent the terminal from being removed in a rearward direction.

2. The electrical connector assembly set forth in claim 1 wherein the secondary terminal lock projects forward.

3. The electrical connector assembly set forth in claim 2 wherein the inner connector has a side wall, the shaft of the secondary terminal lock being disposed flush with the side wall prior to deflection.

4. The electrical connector assembly set forth in claim 3 wherein the cam lobe of the secondary terminal lock is disposed laterally outward from the side wall of the inner connector prior to deflection of the shaft.

5. The electrical connector assembly set forth in claim 4 wherein the slot of the outer housing is defined by planar inner surface disposed laterally outward and directly adjacent to the side wall of the inner connector, the cam lobe of the secondary terminal lock being engaged to the inner surface when the electrical connector assembly is mated.

6. The electrical connector assembly set forth in claim 5 further comprising:

the terminal having a primary lock projecting laterally outward; and the side wall of the inner connector having a forward facing abutting surface disposed in oppositional engagement to the primary lock.

7. The electrical connector assembly set forth in claim 6 further comprising:

the inner connector having a forward projecting flexible locking arm having a forward beveled tang projecting laterally outward; and the outer housing having a staged hole and a mating hole, wherein the beveled tang snaps into the staged hole when the electrical connector assembly is in the staged position, and wherein further insertion of the inner connector causes the beveled tang to release from the staged hole and snap into the mating hole when the electrical connector assembly is mated.

8. The electrical connector assembly set forth in claim 7 wherein the locking arm deflects inward and the beveled tang snaps laterally outward into either the staged hole or the mating hole.

9. The electrical connector assembly as set forth in claim 8 further comprising:

the outer housing having a staged distance and a shroud, the shroud having a cam surface along a trailing edge, the staged distance measured forward from the cam surface to the staged hole; and the inner connector having a staged length measured forward from the cam lobe of the secondary terminal lock to the beveled tang of the locking arm, the staged length of the inner connector being slightly greater than the staged distance of the outer housing.

10. The electrical connector assembly as set forth in claim 9 wherein the inner connector has a rearward face and a flange, the flange projecting laterally outward from the side wall along the perimeter of the rearward face, the flange being in oppositional engagement to the outer housing thereby preventing over insertion of the inner connector to the outer housing when the electrical connector assembly is mated.

11. The electrical connector assembly as set forth in claim 10 wherein the side wall is one of two opposing side walls each defining respective terminal faces, and wherein the shroud of the outer housing is one of two opposing shrouds, each shroud being disposed adjacent to the respective side wall.

12. An electrical connector assembly comprising:

an inner connector defining a terminal space adapted to receive a wire terminal;

an outer housing defining a slot adapted to receive the inner connector in telescoping engagement;

the inner connector having a secondary terminal lock having a base, a shaft and a head, the shaft located between the head and the base, the base engaged to the inner connector, the head having a forward facing abutment, the secondary terminal lock being disposed adjacent the terminal space so that when the assembly is assembled with a terminal disposed in the terminal space and with the inner connector fitting within the outer housing, a cam lobe of the head faces outward from the inner connector and abuts the outer housing and causes the shaft and head to deflect inward and move the abutment behind the terminal to prevent the terminal from being removed in a rearward direction;

wherein the secondary terminal lock projects forward;

wherein the inner connector has a side wall, the shaft of the secondary terminal lock being disposed flush with the side wall prior to deflection;

wherein the cam lobe of the secondary terminal lock is disposed laterally outward from the side wall of the inner connector prior to deflection of the shaft;

wherein the slot of the outer housing is defined by planar inner surface disposed laterally outward and directly adjacent to the side wall of the inner connector, the cam lobe of the secondary terminal lock being engaged to the inner surface when the electrical connector assembly is mated;

the terminal having a primary lock projecting laterally outward;

the side wall of the inner connector having a forward facing abutting surface disposed in oppositional engagement to the primary lock;

the inner connector having a forward projecting flexible locking arm having a forward, beveled tang projecting laterally outward;

the outer housing having a staged hole and a mating hole, wherein the beveled tang snaps into the staged hole when the electrical connector assembly is in the staged position, and wherein further insertion of the inner connector causes the beveled tang to release from the staged hole and snap into the mating hole when the electrical connector assembly is mated;

wherein the locking arm deflects inward and the beveled tang snaps laterally outward into either the staged hole or the mating hole;

the outer housing having a staged distance and a shroud, the shroud having a cam surface along a trailing edge, the staged distance measured forward from the cam surface to the staged hole;

the inner connector having a staged length measured forward from the cam lobe of the secondary terminal lock to the beveled tang of the locking arm, the staged length of the inner connector being slightly greater than the staged distance of the outer housing;

wherein the inner connector has a rearward face and a flange, the flange projecting laterally outward from the side wall along the perimeter of the rearward face, the flange being in oppositional engagement to the outer housing thereby preventing over insertion of the inner connector to the outer housing when the electrical connector assembly is mated;

wherein the side wall is one of two opposing side walls each defining respective terminal faces, and wherein the shroud of the outer housing is one of two opposing shrouds, each shroud being disposed adjacent to the respective side wall; and wherein the inner connector has a forward face, an aperture and a ledge, the opposing side walls extending between the forward and rearward faces, the forward face defining the aperture, the aperture communicating with the terminal face, the ledge projecting laterally into the terminal space near the aperture, the ledge disposed forward of the terminal and in oppositional engagement to the terminal thereby preventing over insertion of the terminal into the inner connector.

13. An electrical connector assembly comprising:

an inner connector having a rear face, a forward face, opposing side walls and a plurality of elongated terminal spaces, each one of the opposing side walls and each one of the plurality of terminal spaces extending forward from the rear face to the forward face, the plurality of terminal spaces defined between the opposing side walls, each one of the plurality of terminal spaces adapted to receive a respective one of a plurality of wire terminals;

an outer housing having opposing inner surfaces defining a slot adapted to receive the inner connector in telescoping engagement, each one of the opposing inner surfaces being adjacent to a respective one of the opposing side walls;

the inner connector having a plurality of elongated secondary terminal locks projecting forward from the rear face, the plurality of secondary terminal locks having a base, a shaft and a head, the shaft engaged between the head and the base, the base engaged to the inner connector near the rear face, the head having a forward facing abutment;

wherein each one of the shafts of the plurality of secondary terminal locks are disposed flush with a respective one of the opposing side walls prior to deflection;

wherein each one of cam lobes of plurality of secondary terminal locks are disposed laterally outward from a respective one of the adjacent side walls of the inner connector prior to deflection of the shafts; and wherein each one of the secondary terminal locks are disposed adjacent to a respective one of the plurality of terminal spaces so that when the electrical connector assembly is assembled with each one of the plurality of terminals disposed in a respective one of the plurality of terminal spaces and with the inner connector fitting within the outer housing, each one of the cam lobes of the plurality of secondary terminal locks abuts a respective one of the opposing inner surfaces of the outer housing causing the shafts and heads to deflect inward and move the abutments behind the respective one of the plurality of terminals to prevent the plurality of terminals from being moved in a rearward direction.

14. An electrical connector assembly comprising:

a wire terminal having a primary lock;

an inner connector defining a terminal space adapted to receive the wire terminal, wherein the primary lock of the terminal locks to the inner connector preventing the terminal from being removed in a rearward direction;

an outer housing defining a slot adapted to receive the inner connector in telescoping engagement wherein the inner connector mates to the outer housing when moving from a staged position to a mated position and wherein the wire terminal is locked to the inner connector prior to such movement from the staged position via the primary lock; and the inner connector having a secondary terminal lock having a base, a shaft and a head, the shaft located between the head and the base, the base integral with the inner connector, the head having a forward facing abutment, the secondary terminal lock being disposed adjacent the terminal space so that when the inner connector is moving from the staged position to the mated position with the terminal locked in the terminal space and with the inner connector disposed within the outer housing, a cam lobe of the head abuts the outer housing and causes the shaft and head to deflect inward and move the abutment behind the terminal to further pre vent the terminal from being removed in a rearward direction.

* * * * *

UNITED STATES PATENT AND TRADEMARK OFFICE

CERTIFICATE OF CORRECTION

PATENT NO. : 6,533,611 B1
DATED : November 25, 2002
INVENTOR(S) : John R. Morello et al.

It is certified that error appears in the above-identified patent and that said Letters Patent is hereby corrected as shown below:

Column 4,
Line 35, after "removes one" delete "fill" and insert therein -- full --

Column 8,
Line 14, after "to further" delete "pre vent" and insert therein -- prevent --

Signed and Sealed this

Thirteenth Day of May, 2003

JAMES E. ROGAN
*Director of the United States Patent and Trademark Office*